United States Patent [19]

Gamberini

[11] Patent Number: 4,760,853

[45] Date of Patent: Aug. 2, 1988

[54] DEVICE FOR FEEDING CIGARETTES TO THE WRAPPING LINE OF A PACKAGING MACHINE

[75] Inventor: Antonio Gamberini, Bologna, Italy

[73] Assignee: G.D. Societá per Azioni, Bologna, Italy

[21] Appl. No.: 559,825

[22] Filed: Dec. 9, 1983

[30] Foreign Application Priority Data

Dec. 22, 1982 [IT] Italy ..... 3628 A/82

[51] Int. Cl.[4] ..... A24C 5/35; B07C 5/34

[52] U.S. Cl. ..... 131/283; 131/282; 209/535

[58] Field of Search ..... 131/282, 283; 209/535

[56] References Cited

U.S. PATENT DOCUMENTS 4,363,332 12/1982 Preston et al. ..... 131/282

*Primary Examiner*—V. Millin

*Attorney, Agent, or Firm*—Ladas & Parry

[57] ABSTRACT

A device for feeding cigarettes to the wrapping line of a packaging machine, comprising an inlet hopper the lower portion of which contains the cigarettes in the form of piles which move stepwise along respective exit channels from the hopper sensor for checking in succession the cigarettes in the channels at each feed step of the piles, and at least one cigarette expulsion device controlled by the sensor means and disposed along the channels downstream of said sensor means in the feed direction of the piles.

The device is provided with retention means arranged to prevent, during each halt stage of the piles of cigarettes, vertical movements of the cigarettes adjacent to those disposed in correspondence with the expulsion device.

2 Claims, 1 Drawing Sheet

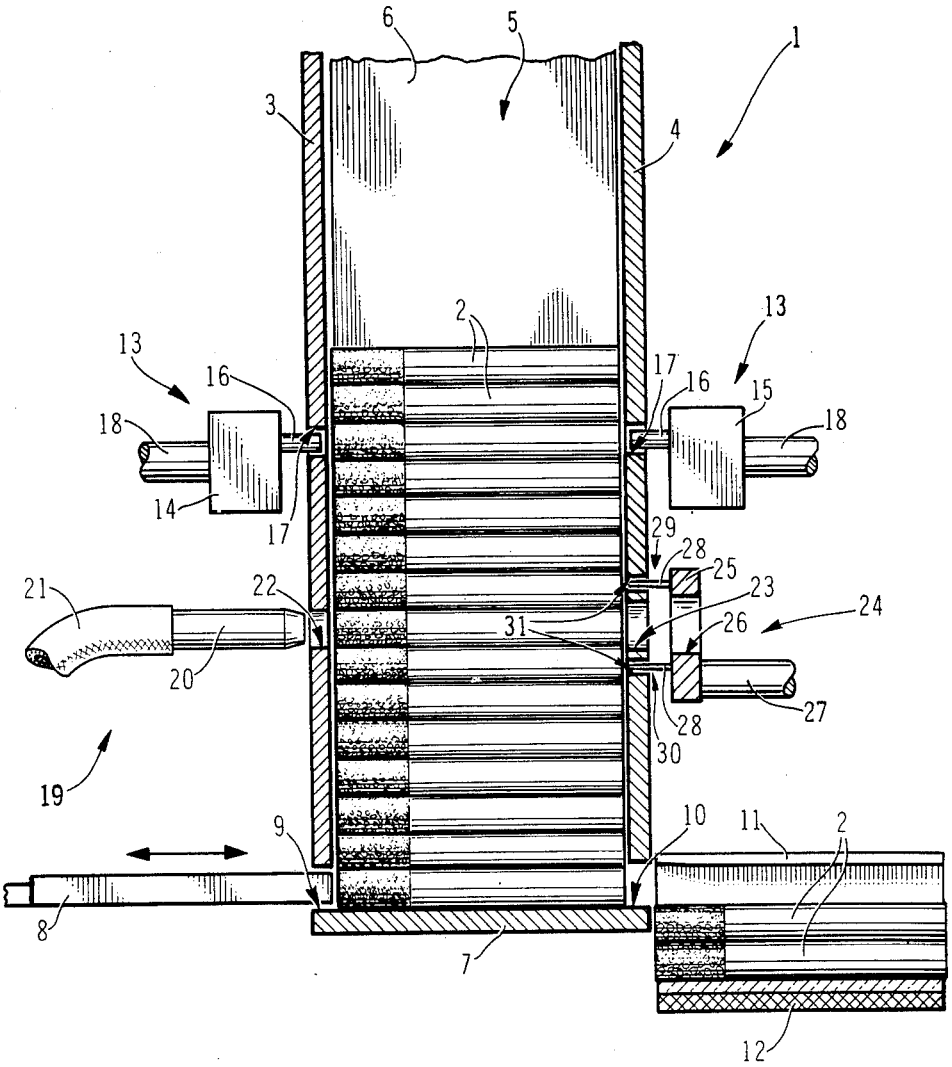
1
2
3
4
5
6
7
8
9
10
11
12
13
14
15
16
17
18
19
20
21
22
23
24
25
26
27
28
29
30
31

DEVICE FOR FEEDING CIGARETTES TO THE WRAPPING LINE OF A PACKAGING MACHINE

This invention relates to a device for feeding cigarettes to the wrapping line of a packaging machine.

In the known art, cigarettes usually enter a pachaging machine through a hopper, to which the cigarettes are fed by suitable containers or by means of a belt convenyor which conveys them in the form of a continuous layer. At their exit from the hopper, the cigarettes are combined into groups, each comprising a number of cigarettes equal to the number in a finished packet.

The characteristics of the cigarettes of each group are then checked, and groups which comprise even only one defective cigarette are discarded.

In order to reduce the number of cigarette groups expelled, and thus attain a considerable economic saving, the applicant has proposed in German patent application No. P 31 10 927.6 a device able to test the regularity of the cigarettes while they are still in the hopper, and to discard them before they reach the grouping station. In this device, the cigarettes are expelled from the hopper preferably by means of a pneumatic expulsion means which axially directs a blast of compressed air against the cigarettes found to be defective, thus expelling them through suitable apertures provided in the hopper.

However, a device of this type is not free from drawbacks in that it has been found that the defective cigarettes, during their exit from the hopper, frequently dislodge the cigarettes above and below them. In this respect, the cigarettes which lie above the defective ones often cause jamming such as to require stoppage of the packaging machine because the sudden exit of an immediately underlying cigarette causes a sudden uncontrolled descent of overlying cigarettes resulting in their assuming an incorrect orientation.

The cigarettes lying below the discarded ones also tend to become irregularly orientated during expulsion of the defective cigarettes, due to the generation of air vortices which suck them upwards in a disordered manner.

The object of the present invention is to provice a device of the aforesaid type which is free from the drawbacks.

The object is attained according to the present invention by a device for feeding cigarettes to the wrapping line of a packaging machine, comprising a hopper for feeding cigarettes to the machine, the hopper being divided lowerly into exit channels having a width substantially equal to the diameter of one cigarette, and through which the cigarettes disposed in piles descend stepwise; along each of the channels there being provided, from the top downwards, sensor means for checking the cigarettes in succession, and at least one expulsion device controlled by the sensor means in order to expel the defective cigarettes from the hopper; said device being characterised by comprising, for each of the channels, means for retaining at least one of the cigarettes which in the relative pile occupy a position adjacent to the cigarette which is disposed in correspondence with the expulsion device, and operating means for the retention means in order to activate them in synchronism with the stages during which the piles of cigarettes are halted along the channels.

Further characteristics and advantages of the present invention will be more apparent from the detailed description given hereinafter of a preferred embodiment illustrated by way of a non-limiting example on the single accompanying drawing, which represents a diagrammatic elevation of a feed device constructed in accordance with the present invention.

The FIGURE shows an inlet hopper 1 of known type for feeding cigarettes to a cigarette packaging machine (not shown).

The hopper 1 is defined with reference to the FIGURE by a left hand wall 3 and a right hand wall 4 which are vertical and parallel and which define a compartment having a width slightly greater than one cigarette 2.

The compartment is divided into a plurality of elementary channels 5 (of which only one is shown) by means of walls 6 (of which only one is visible in the FIGURE) disposed at a distance from each other which is slightly greater than the diameter of the cigarettes 2.

The elementary channels 5 are bounded at their lower end by a horizontal wall 7 for supporting the columns of cigarettes 2 contained in the channels 5. The cigarettes 2 can be engaged in groups by a pusher element 8 which is capable of reciprocating motion in a horizontal direction normal to the walls 3 and 4 through slots 9 and 10 provided in the walls 3 and 4. The slots are adjacent the wall 7 and have a height at least equal to the diameter of the cigarettes 2.

The pusher element 8 is movable from a rest position external to the hopper 1 and shown in the FIGURE, to an operating position inside the hopper 1 thereby pushing the cigarettes 2 from the channels 5 into containers 11 (of which only one is shown). The containers 11 are carried by an intermittently moving conveyor belt 12 to permit transferring the groups of cigarettes 2 to a packaging unit (not shown). During this transfer, an expulsion unit (not shown) expels from the conveyor belt 12 those groups of cigarettes which contain one or more defective cigarettes 2.

In order to better understand the structure of the hopper 1, the channels 5, the pusher element 8, the conveyor belt and said expulsion unit (not shown), reference should be made to the description and drawings of British patent No. 1,298,785 and British patent No. 2,023,994 in the name of the present applicant.

Along each channel 5 there is provided a sensor means or control device for checking the soundness of the individual cigarettes 2, indicated overall by 13 and comprising two opposing sensors or feelers 14 and 15 for feeling the ends of the individual cigarettes 2. Each sensor 14, 15 is provided with a feeler pin 16 which is aligned with and opposes the corresponding pin 16 of the other sensor. The pins 16 extend through respective horizontal holes 17 provided in the walls 3 and 4.

The pins are mounted elastically on the respective sensors 14 and 15 and move with reciprocating motion through the respective holes 17 under the thrust of reciprocating pusher elements 18 acting synchronously in opposite directions.

An expulsion device 19 is provided below the control device 13 on the outside of the hopper 1 in front of the wall 3. The expulsion device 19 is spaced-apart from the position of the pins 16 by a distance equal to or a multiple of the diameter of a cigarette 2, and is constituted by a nozzle 20 which is connected by a pipe 21 to a source of compressed air, not shown. The nozzle 20 is able to direct a substantially horizontal blast of air into the channel 5 through a hole 22 in the wall 3. A hole or aperture 23 for the exit of the discarded cigarettes 2 is provided in the wall 4 of the hopper 1 in alignment with the hole 22.

The control device 13 is connected to a normally open contact (not shown) which closes if the feeler pins detect a cigarette 2 which is too short or is not sufficiently full of tobacco at its ends.

By way of a memory element (not shown), the contact is able to activate the expulsion device 19 in order to expel the defective cigarettes 2 when they are halted in alignment with the holes 22 and 23.

Reference should be made to the description of German patent application No. P 31 10 927.6 for a better understanding of the operation of the control device 13 and expulsion device 19.

At the same level as the expulsion device there is provided a retention means or device 24 facing the wall 4 of the hopper 1 proximal the exit hole 23 for the discarded cigarettes 2. The retention device comprises a support element 25 constituted by a plate parallel to the wall 4 and comprising a longitudinal slot 26 arranged to allow the discarded cigarettes 2 to leave the hopper 1. The plate 25 is supported by a pusher element or operating means 27 driven with reciprocating motion and able to cause the plate 25 to approach the wall 4 during each halt of the piles of cigarettes 2 in the hopper 1, and to immediately withdraw it before the cigarettes 2 again begin to move downwards following the movement of the pusher 8.

On that side facing the hopper 1, the plate 25 supports a plurality of needles or engagement means 28 (of which only two are visible in the FIGURE) extending parallel to the axes of the cigarettes 2. The needles 28 are disposed in two horizontal rows 29 and 30, the first immediately above and the second immediately below the holes 23.

Holes 31 are provided in the wall 4 to allow the needles 28 to enter the hopper 1.

The operation is as follows. During the halt stage of each machine cycle, the pins 16 test a cigarette 2 in each of the channels 5 through the holes 17. When a cigarette 2 is found to be defective, the control device 13, by way of the memory device, arranges for the cigarette 2 to be discarded as it passes in front of the expulsion device 19.

Immediately prior to the commencement of each control stage and while the cigarettes 2 in the expulsion position are at rest, the pusher element 27 causes the plate 25 to approach the wall 4, causing the needles 28 penetrate the ends of the cigarettes 2 through the holes 31. As a result of this, the drawhacks described with reference to the known art do not arise when any cigarette 2 is expelled from the channel 5 by the nozzle 20, because the cigarettes 2 lying above and below the discarded cigarette are immobilised by and between the needles 28. Just before the cigarettes 2 of each channel 5 begin to move downwards under the action of the pusher 8, the pusher element 27 withdraws the plate 25 from the hopper 1, so releasing the cigarettes 2 and allowing them to descend regularly.

Within the scope of the invention, numerous modifications can be made to the described device.

For example, if the control device 13 is disposed immediately upstream of the expulsion device 19, the plate 25 does not require the row 29 of needles 28, the pressure of the pins 16 is sufficient to prevent the uncontrolled fall of the cigarettes 2 lying above the nozzle 20, should a cigarette 2 be discarded. Moreover, the plate 25 can carry any other type of retention means in place of the needles 28, and the control device and expulsion device can be of any type different from those described.

What is claimed is:

1. A device for feeding cigarettes to the wrapping line of a packaging machine, the device comprising: a hopper for feeding cigarettes to said machine, said hopper being divided into channels each having a width substantially equal to the diameter of one cigarette and through which the cigarettes disposed in piles descend stepwise; sensor means in each of said channels for checking for defective cigarettes; at least one expulsion device controlled by said sensor means for expelling the defective cigarette from said hopper; means for retaining the cigarettes both above and below the defective cigarette during expulsion thereof in a fixed position, the means for retaining being driven in a forward and backward movement relative to the hopper, the means for retaining further being provided with engagement means constituted by needles parallel to the cigarettes contained in the hopper, the engagement means engaging the cigarettes; and operating means for said retaining means to activate the retaining means in synchronism with stages during which the piles of cigarettes are halted along said channels.

2. A device as claimed in claim 1 wherein said retaining means are disposed on a side of said hopper opposite to that on which the said expulsion device is mounted, in correspondence with an aperture for the exit of the discarded cigarettes from said hopper.

* * * * *